US007798204B2

(12) United States Patent
Schoell

(10) Patent No.: US 7,798,204 B2
(45) Date of Patent: Sep. 21, 2010

(54) CENTRIFUGAL CONDENSER

(75) Inventor: Harry Schoell, Pompano Beach, FL (US)

(73) Assignee: Cyclone Power Technologies, Inc., Pompano Beach, FL (US)

( * ) Notice: Subject to any disclaimer, the term of this patent is extended or adjusted under 35 U.S.C. 154(b) by 1052 days.

(21) Appl. No.: 11/410,224

(22) Filed: Apr. 24, 2006

(65) Prior Publication Data

US 2007/0056716 A1 Mar. 15, 2007

Related U.S. Application Data

(62) Division of application No. 11/225,422, filed on Sep. 13, 2005, now Pat. No. 7,080,512.

(60) Provisional application No. 60/609,725, filed on Sep. 14, 2004.

(51) Int. Cl.
*B01D 1/22* (2006.01)
*F28F 13/12* (2006.01)
*F24H 3/06* (2006.01)

(52) U.S. Cl. ..... 165/125; 165/122; 159/6.1

(58) Field of Classification Search ..... 165/120, 165/121, 122, 123, 124, 125, 126, 127, 164, 165/165, 166, 167, 51; 159/6.1
See application file for complete search history.

(56) References Cited

U.S. PATENT DOCUMENTS

| | | | | |
|---|---|---|---|---|
| 2,370,309 | A * | 2/1945 | Hartwig | 165/162 |
| 3,640,330 | A * | 2/1972 | Javet | 159/6.1 |
| 3,759,321 | A * | 9/1973 | Ares | 165/125 |
| 4,621,504 | A * | 11/1986 | Tippmann | 165/181 |
| 4,731,159 | A * | 3/1988 | Porter et al. | 159/6.1 |
| 4,981,171 | A * | 1/1991 | Tippmann | 165/125 |
| 6,848,501 | B2 * | 2/2005 | Hirao et al. | 165/166 |

* cited by examiner

*Primary Examiner*—Ljiljana (Lil) V Ciric
(74) *Attorney, Agent, or Firm*—Robert M. Downey, P.A.

(57) ABSTRACT

A centrifugal condenser in an engine has a stacked arrangement of interleaved plates surrounding a central core. Exhaust steam from the engine is directed through interior cavities of the plates while external cooling air from intake blowers circulates over outer surfaces of the plates to cool the plates and condense the steam on the opposite inner side of the plates. The water condensation is returned to a collection pan or sump for subsequent use in the engine.

17 Claims, 5 Drawing Sheets

CENTRIFUGAL CONDENSER

This application is a divisional patent application of patent application Ser. No. 11/225,422 filed on Sep. 13, 2005, now issued U.S. Pat. No. 7,080,512 B2, which was based on U.S. Provisional patent application No. 60/609,725 filed on Sep. 14, 2004.

BACKGROUND OF THE INVENTION

1. Field of the Invention

The present invention relates to a condenser for use in an engine and, more particularly to a condenser having a stacked arrangement of plates surrounding a central core, and wherein the condenser is structured to condense exhaust steam to a liquid state for subsequent use in the engine.

2. Discussion of the Related Art

Condensers typically operate by directing vapor over a surface that has been cooled to a temperature that is sufficient to promote a phase change of the vapor to a liquid state. In many instances, the surface is cooled from the opposite side with the use of a blower system. To a large extent, the efficiency of the condenser is dependent on the amount of cooling surface area available for exposure to the vapor. If the vapor can be exposed to a larger cooling surface area, the efficiency and effectiveness of the condenser will be greater. However, space limitations often dictate the size of the condenser. Conventional condensers operate by passing vapor over the cooling surface one time (i.e. single pass) in a compact space. This single pass of vapor over the cooling surface, combined with the limited area of the cooling surface in the compact space, limits the effectiveness of the condensing operation. In light of the limitations of conventional condenser designs, there remains a need for a condenser that provides a large cooling surface area for maximum heat transfer within a relatively compact volume.

SUMMARY OF THE INVENTION

The present invention is directed to a centrifugal condenser for use in a heat regenerative engine that uses water as both the working fluid and the lubricant. The centrifugal condenser is structured to include a stacked arrangement of interleaved plates formed in a circular vertical wall structure that surrounds an interior core. The vertical wall structure formed by the stacked arrangement of plates provides for increased surface area for maximum heat transfer to condense exhaust steam from the engine. The stacked plates have outer plate surfaces communicating with cooling air from intake blowers and inner plate surfaces communicating with the interior core. The external cooling air from the intake blowers circulates over the outer plate surfaces, while the condensing exhaust vapor from the engine circulates on the opposite inner side of the plates, on the inner plate surfaces.

The exhaust vapor exiting the piston sleeves of the engine passes through pre-heating coils surrounding the pistons sleeves. The vapor then drops by convection into the core of the condenser where the vapor is repeatedly driven by an impeller into the inner cavities of the condenser plates and over the inner plates surfaces. The vapor changes phase into liquid upon contact with the cool plate surfaces. The liquid condensation is urged across the plate surfaces and eventually enters sealed ports situated on the periphery of these plates. The liquid then drops through collection shafts and into a sump at the base of the condenser. A high pressure pump returns the condensed liquid from the sump to coils in a combustion chamber of the engine, thereby completing a fluid cycle of the heat regenerative engine.

The stacked plate design of the centrifugal condenser presents a large surface area for maximizing heat transfer within a relatively compact volume. Repeatedly driving the vapor into the cavities of the cooling plates with the use of a crank shaft driven impeller provides for a multiple pass system that is far more effective than conventional condensers that use a single pass design.

OBJECTS AND ADVANTAGES OF THE INVENTION

It is a primary object of the present invention to provide a condenser for use in an engine and wherein the condenser is structured and disposed to condense exhaust steam to a liquid state in a highly efficient manner.

It is a further object of the present invention to provide a highly efficient condenser for use in an engine, and wherein the condenser is of a compact design having a stacked arrangement of interleaved plates.

It is still a further object of the present invention to provide a highly efficient and compact centrifugal condenser having a stacked arrangement of interleaved plates surrounding a central core, and wherein an impeller repeatedly drives condensing vapor into the stacked cooling plates to provide for a highly efficient multiple pass system that is far more effective than conventional condensers.

It is still a further object of the present invention to provide a centrifugal condenser having a stacked arrangement of flat plates that provide a large surface area for maximum heat transfer within a compact volume.

These and other objects and advantages of the present invention are more readily apparent with reference to the detailed description and accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DESCRIPTION OF THE PREFERRED EMBODIMENT

Figure 1:
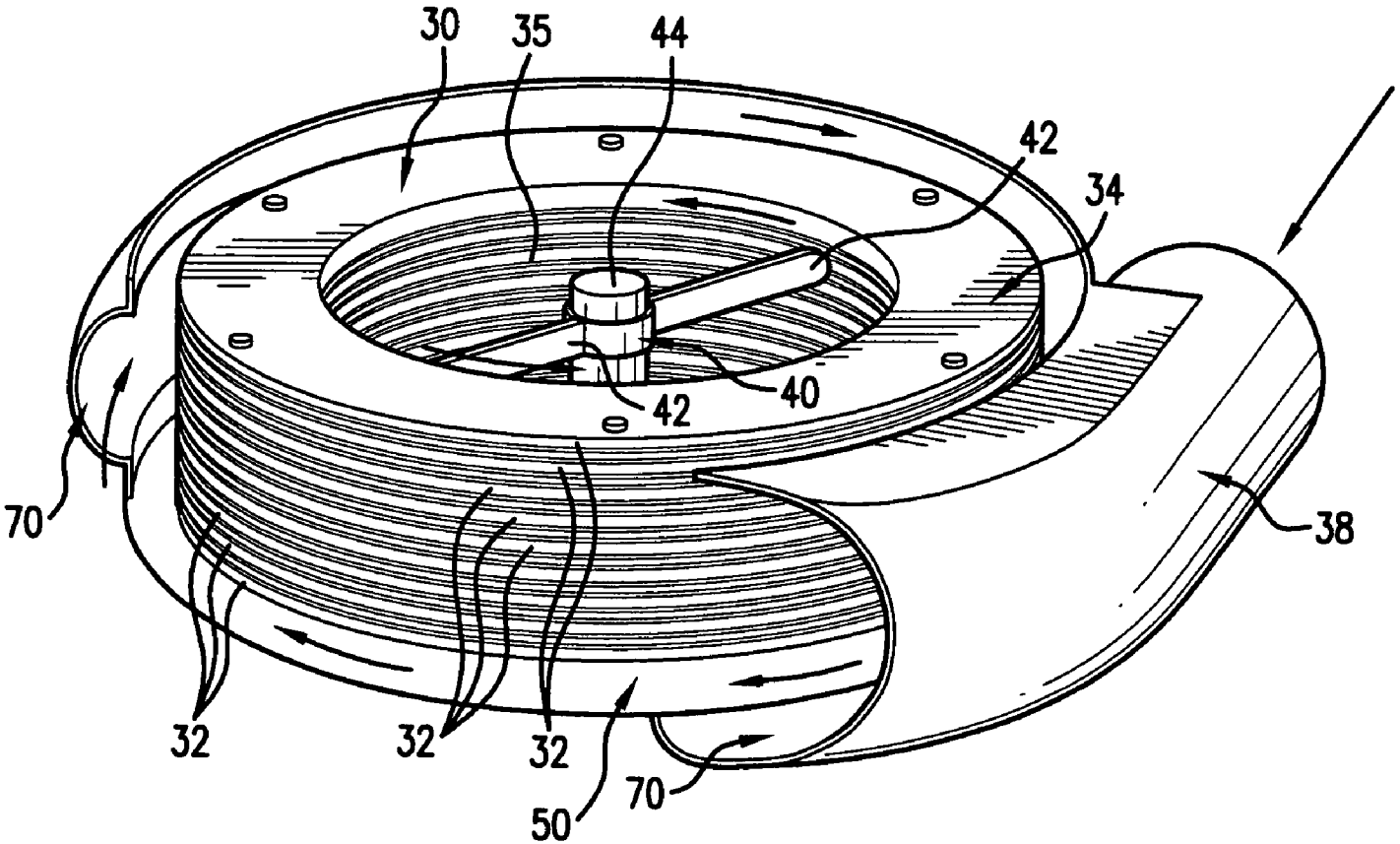
FIG. 1 is a perspective view of the centrifugal condenser of the present invention shown surrounded by external cooling air intake ducts.

The present invention is directed to a centrifugal condenser 30 having a stacked arrangement of interleaved metal plates 32 forming a circular wall structure 34 that surrounds and inner core 35 of the condenser. The centrifugal condenser is particularly suited for use in a heat regenerative engine 10 that uses water as both the working fluid and the lubricant. The metal plates 32 forming the wall structure 34 may be manufactured from any suitable material comprising good conductivity, corrosion resistance to air and water and strength as a low pressure vessel. In a preferred embodiment, the plates 32 are manufactured from cut or cast aluminum, stainless steel, or copper. The wall structure 34 formed by the stacked plate arrangement provides outer plate surfaces and inner plate surfaces. More particularly, an outboard side 50 of the wall structure 34 has outer plate surfaces including top plate surfaces 52 and bottom plate surfaces 54. A radial gap 56 is provided between the plates to expose the top and bottom plate surfaces. On an opposite side, exposed to the inner core 35, the wall structure has inner plate surfaces including inner top plate surfaces 62 and inner bottom plate surfaces 64. Opposing top and bottom inner plate surfaces, have an inner radial gap 66 between them forming an inner cavity. These inner radial gaps or cavities, between the spaced top and bottom plate surfaces, are open towards the core 35 of the condenser.

Figure 2:
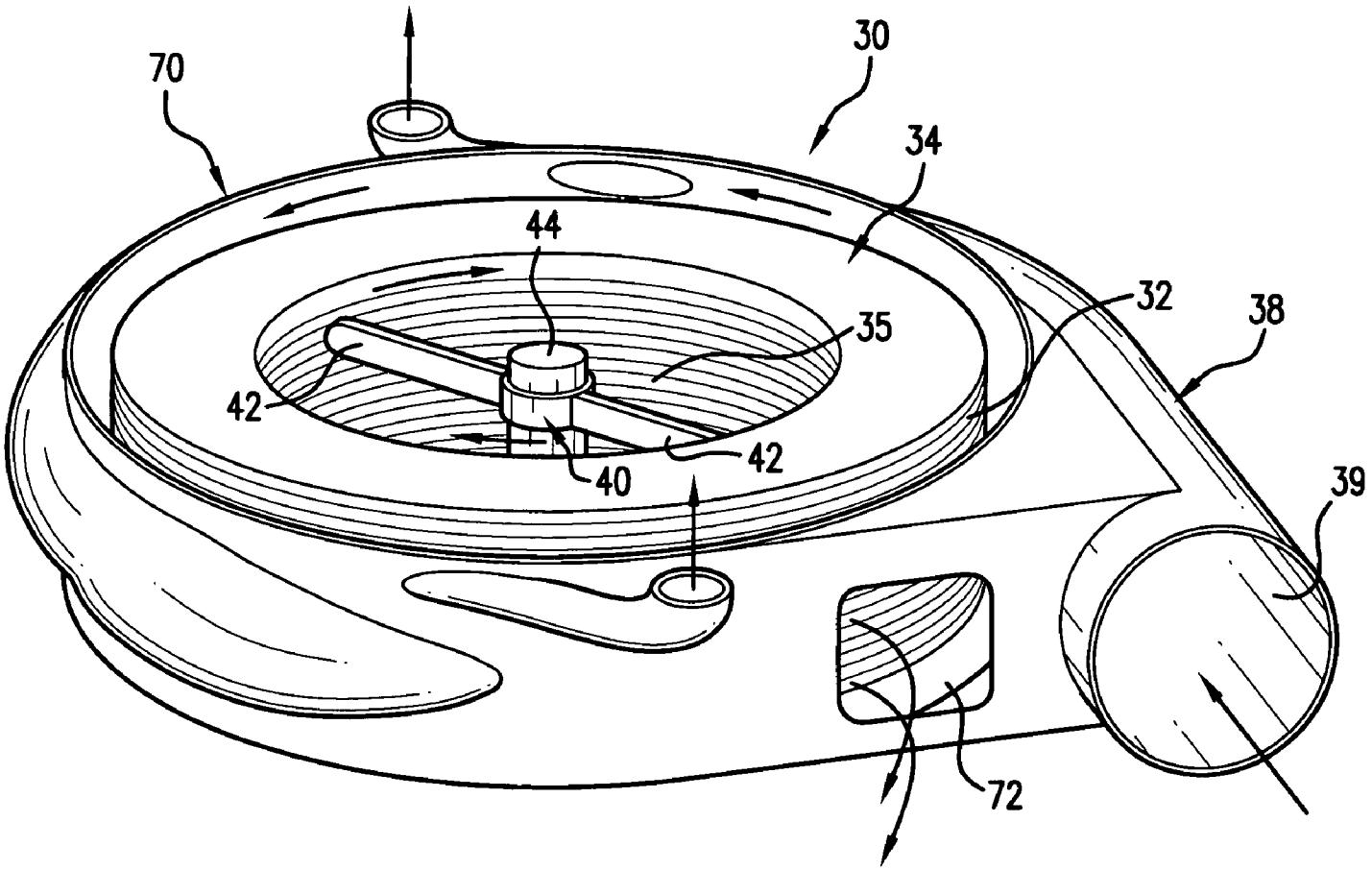
FIG. 2 is a perspective view of the centrifugal condenser, viewed from an opposite side from that seen in FIG. 1, and showing intake and exhaust ports of the air duct system.
Figure 3:
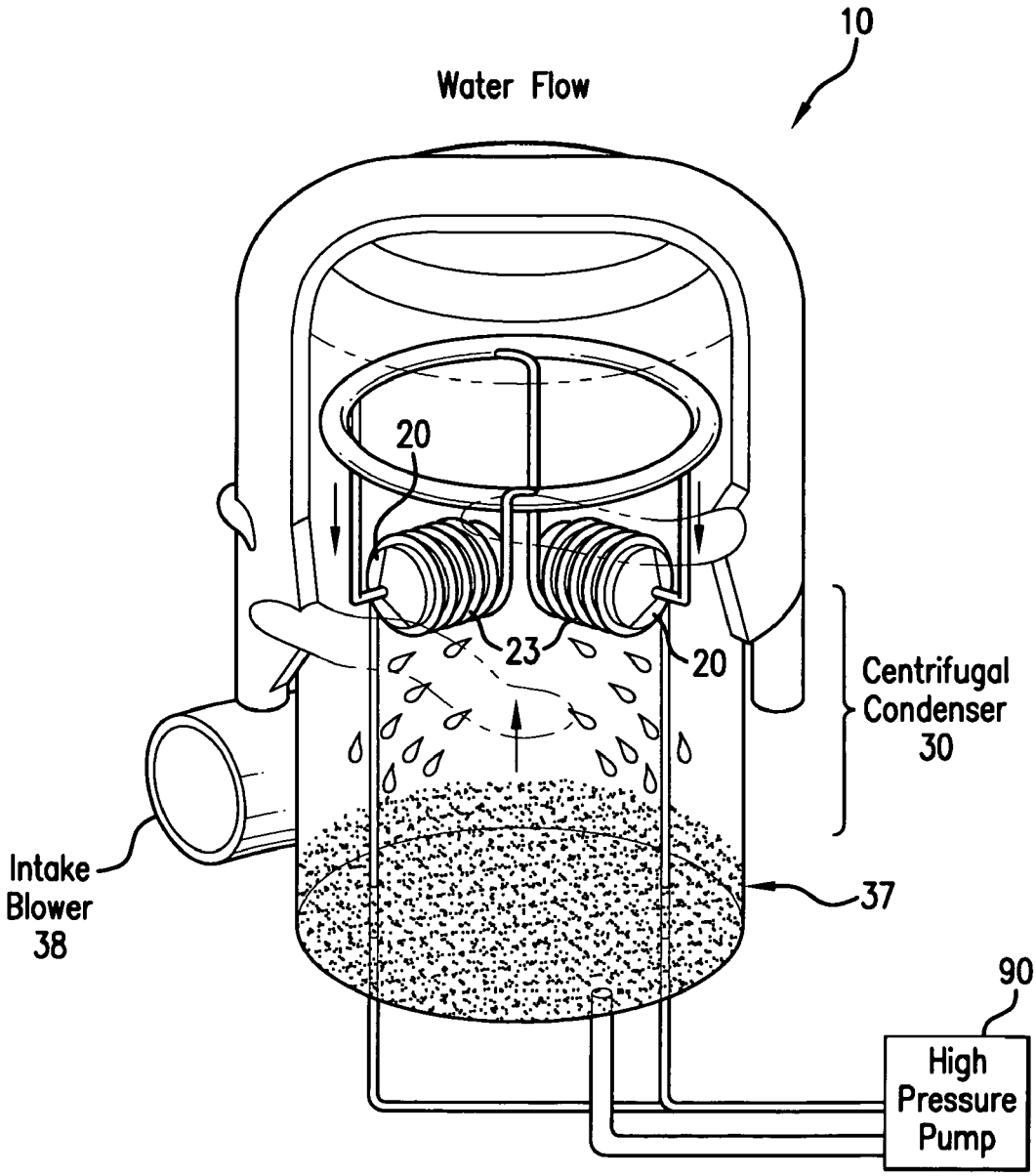
FIG. 3 is a general diagram illustrating a water and steam flow system in a heat regenerative engine incorporating the centrifugal condenser of the present invention.

An impeller 40, driven by a crank shaft of the engine 10, is situated within the inner core 35. The impeller 40 has blades 42 that extend radially outward from a shaft 44 that is maintained on the central axis 46 of the inner core 35. As seen in FIG. 2, a sump 37 for collecting condensed liquid is positioned below the stacked plate arrangement of the centrifugal condenser.

In operation, ambient air is introduced into the centrifugal condenser 30 through one or more intake ports 39 by the force of intake blowers 38. As seen in FIGS. 1 and 2, the intake blowers 38 force the ambient cooling air through a circular duct system 70 surrounding the stacked plate arrangement of the centrifugal condenser. The structural design of the condenser plates 32 allows for multiple passes of steam to enhance the condensing function. The air is heated while passing around the duct system and condenser plates. Exhaust air is further ducted into two grades of heated air. Warm air is ducted to atmosphere through exhaust port 72. Hotter air is ducted through hot exhaust ducts 74 that deliver the hot exhaust air to the combustion chamber of the engine.

Figure 4:
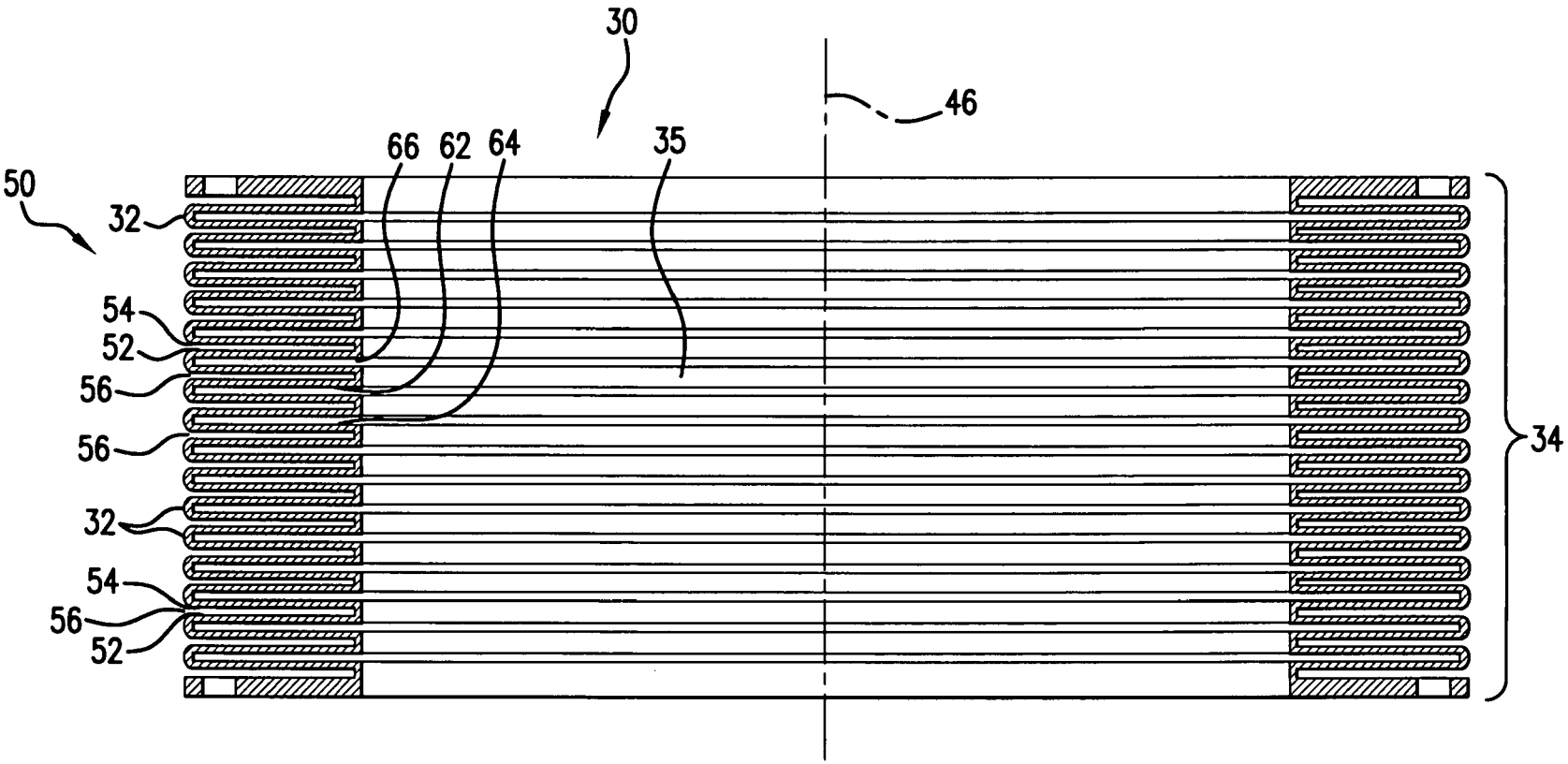
FIG. 4 is a cross-sectional view of the centrifugal condenser plates.
Figure 5:
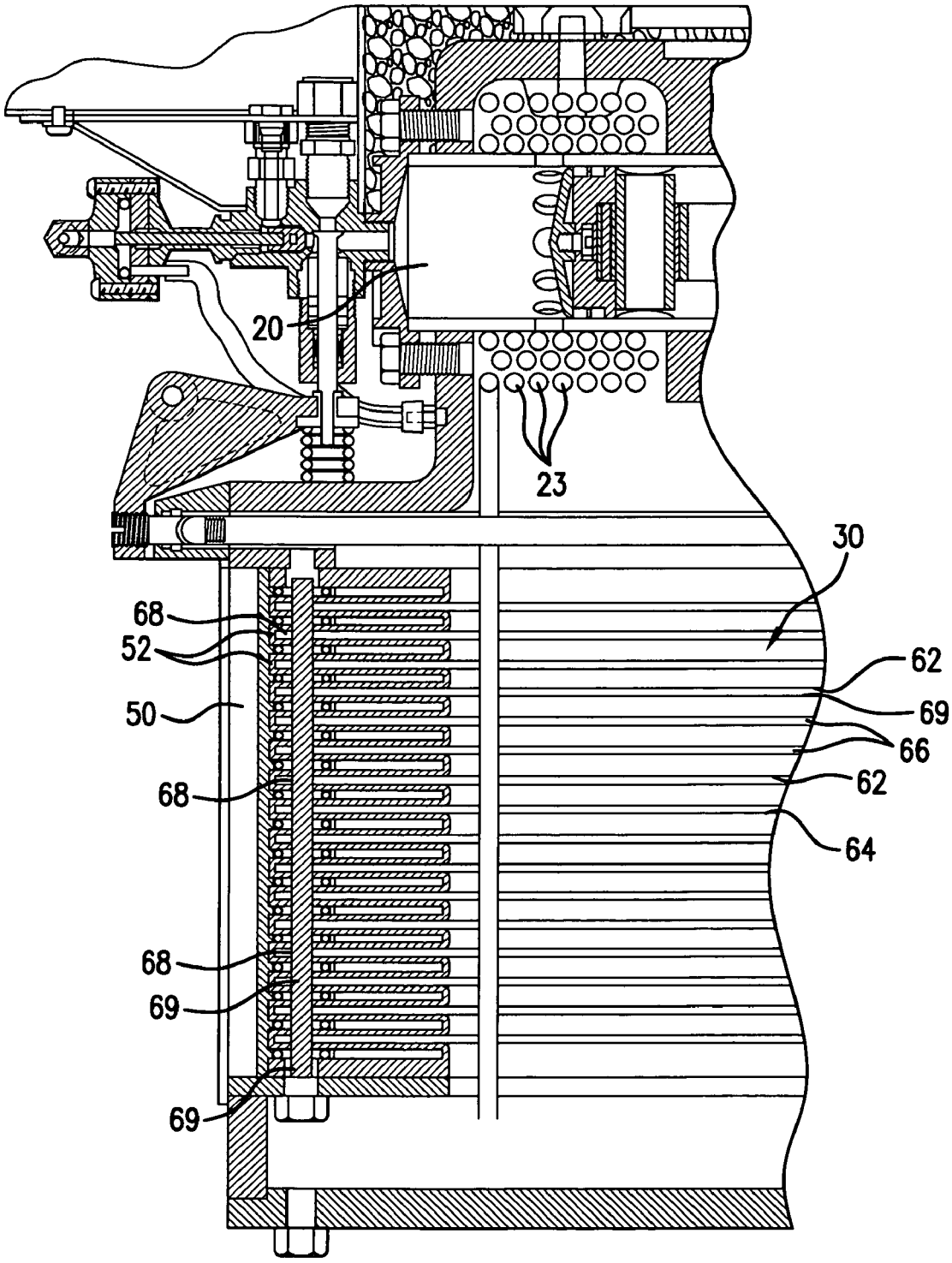
FIG. 5 is an isolated cross-sectional view, in cut-away, showing a portion of the centrifugal condenser below a piston sleeve and pre-heating coils in the engine.

In operation, external cooling air enters the condenser 30 from the intake blowers 38 and is circulated over the outer surfaces 52,54 of the condenser plates 32. This cools the outer plate surfaces. Vapor that exits exhaust ports of cylinders 20 of the engine 10 passes through pre-heating coils 23 surrounding the cylinders 20, as seen in FIG. 4. The vapor then drops into the core 35 of the condenser 30 where a centrifugal force from rotation of the impeller 40 drives the vapor into the inner cavities 66 of the condenser plates and into contact with the inner plate surfaces 62,64. The cool temperature of the plates, having been cooled on the outer surfaces 52,54 by the external cooling air, causes the vapor to be condensed into a liquid form upon contact with the inner plate surfaces. When the vapor changes phase into a liquid, the liquid is directed through sealed ports 68 on the periphery of the condenser plates. The condensed liquid then drops through collection shafts 69 and into the sump 37 at the base of the condenser 30. A high pressure pump 90 returns the liquid from the condenser sump to coils in a combustion chamber of the engine, completing the fluid cycle of the engine.

The stacked arrangement of condenser plates presents a large surface area for maximizing heat transfer within a relatively compact volume. The centrifugal force of the crank shaft driven impeller that repeatedly drives the condensing vapor into the cooling plates, combined with the stacked plate design, provides for a multiple pass system that is far more efficient and effective than conventional condensers that use a single pass design.

While the present invention has been shown and described in accordance with a preferred and practical embodiment, it is recognized that departures from the instant disclosure are contemplated within the spirit and scope of the present invention.

What is claimed is:

1. A centrifugal condenser for use in an engine that produces exhaust steam, said centrifugal condenser comprising:

a stacked arrangement of metal plates forming a vertical wall structure having an outboard side and an inner side surrounding an open central core, and said plates being structured and arranged to include outer top and bottom surfaces facing outer radial gaps that are open to said outboard side, and said plates further including inner top and bottom surfaces facing inner radial gaps that are open towards said central core;

an air duct surrounding said outboard side of said vertical wall structure of said stacked arrangement of metal plates;

at least one intake blower structured and disposed for intake and forced distribution of ambient cooling air through said air duct, into said outer radial gaps and across the outer top and bottom surfaces of said plates for cooling said plates;

a rotatable impeller within said central core for driving the exhaust steam into the inner radial gaps and against the inner top and bottom surfaces of said plates to cause the steam to condense into a liquid; and at least one passage formed in said stacked arrangement of metal plates for directing the condensed liquid to a collection reservoir.

2. The centrifugal condenser has recited in claim 1 wherein said outer top and bottom surfaces of said plates are flat.

3. The centrifugal condenser as recited in claim 1 wherein said vertical wall structure is circular.

4. The centrifugal condenser as recited in claim 3 wherein said vertical wall structure is an integral pleated wall forming said stack arrangement of metal plates.

5. The centrifugal condenser as recited in claim 1 wherein said at least one passage includes a sealed port and vertical shaft in fluid communication with said sealed port and the inner top and bottom surfaces of said plates.

6. The centrifugal condenser as recited in claim 1 further comprising a plurality of said intake blowers, each of said plurality of intake blowers being structured and disposed for delivering forced distribution of ambient cooling air through said air duct, into said outer radial gaps and across the outer top and bottom surfaces of said plates for cooling said plates.

7. The centrifugal condenser as recited in claim 1 further comprising a plurality of said passages for directing the condensed liquid to a collection reservoir.

8. A centrifugal condenser for use in an engine that produces exhaust steam, said centrifugal condenser comprising:

a stacked arrangement of plates forming a vertical wall structure having an outboard side and an inner side surrounding an open central core, said plates being formed of a heat transfer material, and said plates being structured and arranged to include outer top and bottom surfaces facing outer radial gaps that are open to said outboard side, and said plates further including inner top and bottom surfaces facing inner radial gaps that are open towards said central core;

said plates being structured and arranged to receive cooling air flow within said outer radial gaps and across the outer top and bottom surfaces of said plates for cooling said plates;

said inner radial gaps being structured and disposed for passage of the exhaust steam therein, from within said central core, to expose the steam to said inner top and bottom surfaces and to cause the steam to condense into a liquid; and at least one passage formed in said stacked arrangement of plates for directing the condensed liquid to a collection reservoir.

9. The centrifugal condenser as recited in claim 8 wherein said outer top and bottom surfaces of said plates are flat.

10. The centrifugal condenser as recited in claim 8 wherein said vertical wall structure is circular.

11. The centrifugal condenser as recited in claim 8 further comprising:

an air duct surrounding said outboard side of said vertical wall structure of said stacked arrangement of plates.

12. The centrifugal condenser as recited in claim 11 further comprising:

at least one intake blower structured and disposed for intake and forced distribution of ambient cooling air through said air duct, into to said outer radial gaps and across the outer top and bottom surfaces of said plates for cooling said plates.

13. The centrifugal condenser as recited in claim 8 further comprising:

a rotatable impeller within said central core for driving the exhaust steam into the inner radial gaps and against the inner top and bottom surfaces of said plates to cause the steam to condense into the liquid.

14. The centrifugal condenser as recited in claim 8 wherein said at least one passage includes a sealed port and a vertical shaft in fluid communication with said sealed port and the inner top and bottom surfaces.

15. The centrifugal condenser as recited in claim 8 wherein said stacked arrangement of said plates is formed as a one piece integral unit.

16. The centrifugal condenser as recited in claim 15 wherein said one piece integral unit is formed of aluminum.

17. The centrifugal condenser as recited in claim 15 wherein said one piece integral unit is stainless steel.

* * * * *